United States Patent [19]

Richardson

[11] 4,022,343

[45] May 10, 1977

[54] PROTECTIVE DEVICE FOR COMPRESSED GAS CYLINDERS

[76] Inventor: John Eric Richardson, P.O. Box 1004, El Dorado, Ark. 71730

[22] Filed: Sept. 17, 1976

[21] Appl. No.: 724,233

[52] U.S. Cl. ..... 220/3; 220/69; 220/85 P; 150/52 R; 150/52 H; 220/4 R

[51] Int. Cl.[2] ..... B65D 7/42; B65D 25/00; B65D 7/00

[58] Field of Search ..... 220/4 R, 4 B, 3, 85 P, 220/66, 69, 85 R; 150/52 R, 52 F, 52 H

[56] References Cited

UNITED STATES PATENTS

| | | | |
|---|---|---|---|
| 1,413,502 | 4/1922 | Steinmetz | 220/3 X |
| 2,465,095 | 3/1949 | Harvey | 220/85 P X |
| 3,756,450 | 9/1973 | Crose, Jr. | 220/85 P |

*Primary Examiner*—William Price
*Assistant Examiner*—Steven M. Pollard
*Attorney, Agent, or Firm*—Diller, Brown, Ramik & Wight

[57] ABSTRACT

This disclosure is directed to a protective device for compressed gas cylinders and includes a pair of caps each including an end wall and a peripheral skirt with one of the caps being of a generally inverted frusto-conical configuration and being adapted to receive in a chamber thereof a valve assembly of a compressed gas cylinder, each cap having aligned grooves lying in an axial plane and apertures in the same plane in which and through which, respectively, are disposed strap means for holding the caps positioned upon an associated compressed gas cylinder. The frusto-conical cap includes exterior pairs of projections to prevent rotation of the device about its axis when resting upon a support, as well as internally directed ribs for maintaining alignment between the frusto-conical cap and the compressed gas cylinder.

16 Claims, 4 Drawing Figures

FIG. 1
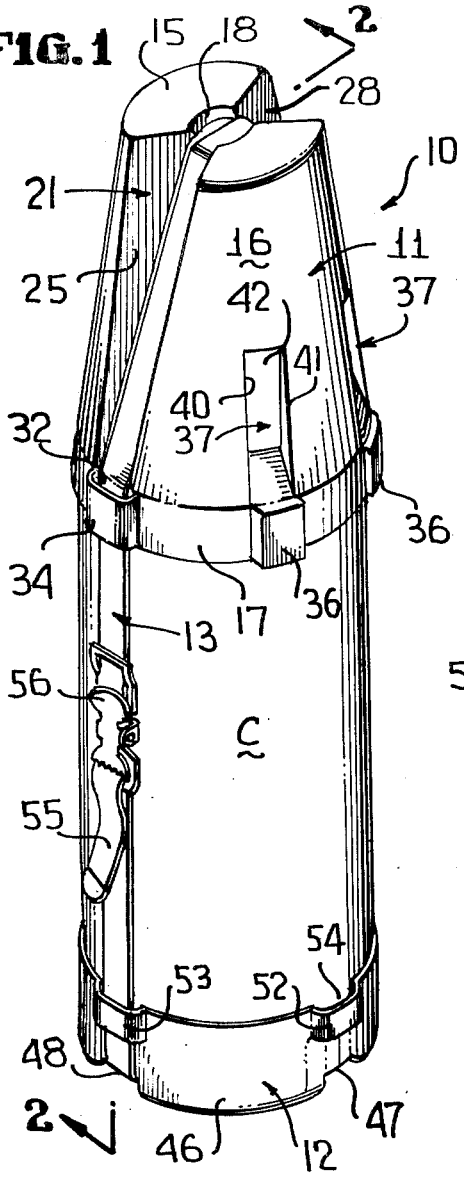
FIG. 2
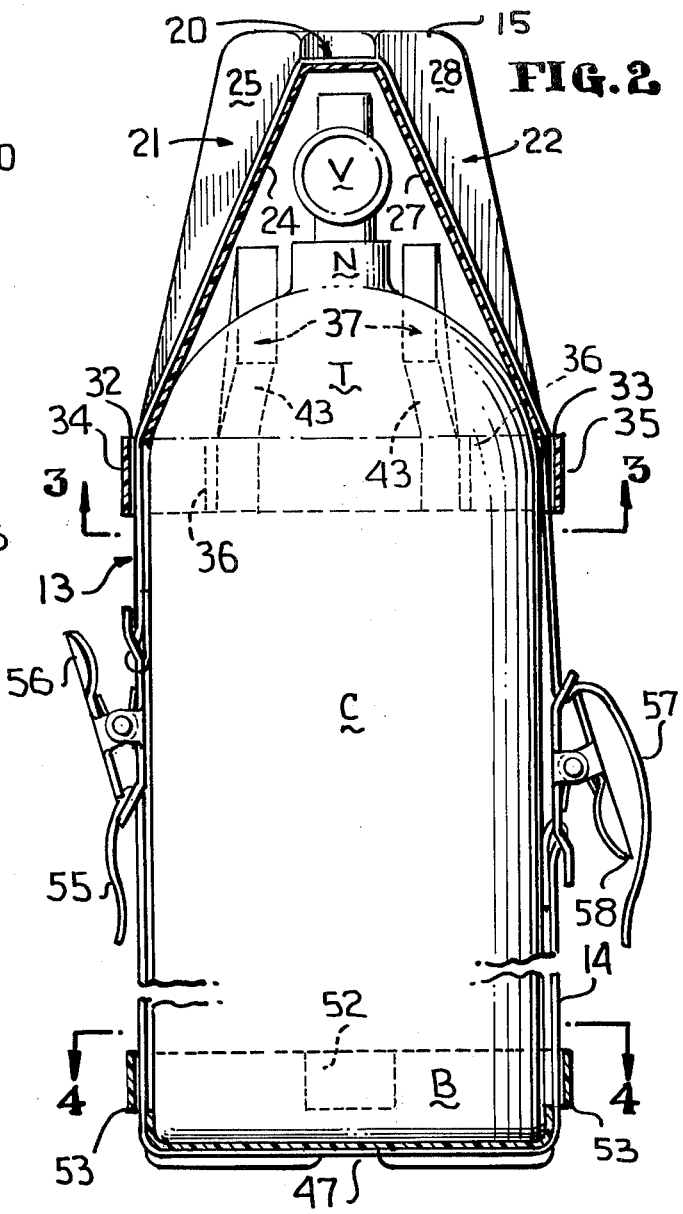
FIG. 3
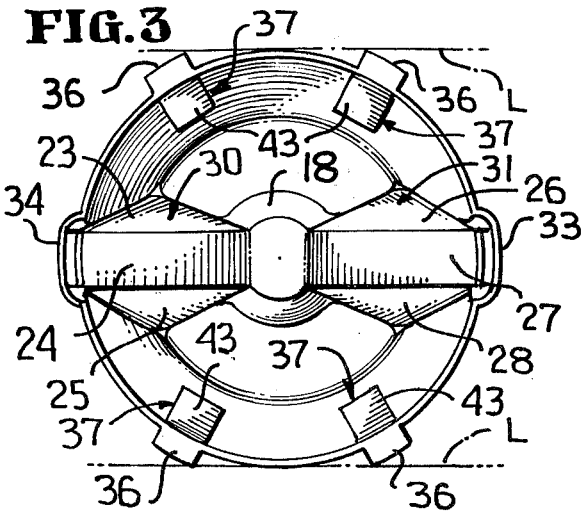
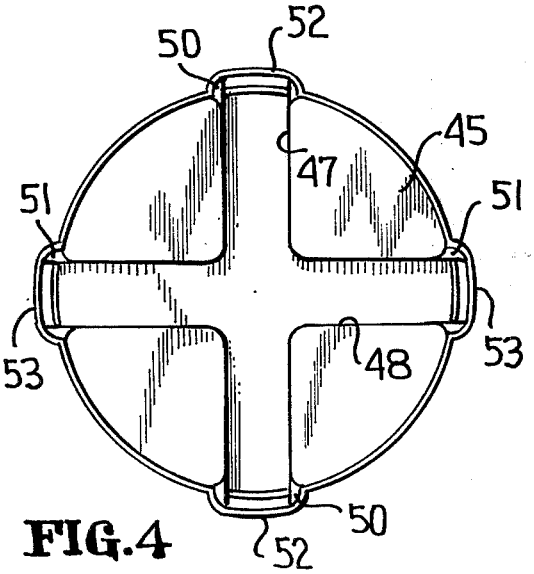
FIG. 4

PROTECTIVE DEVICE FOR COMPRESSED GAS CYLINDERS

Conventional compressed gas cylinders generally include at a neck end thereof a valve assembly which in a most simplified form would include an inlet, an outlet and a manual control valve. If, as has happened on numerous occasions in the past, a compressed gas cylinder is dropped or tips with a force sufficient to fracture the valve assembly, the rapid exodus of the compressed media essentially transforms the cylinder into a missile which is capable of creating extensive damage, not only to inanimate objects but humans as well. Recognizing the dangers attributable to compressed gas cylinders whose valve assemblies have been fractured or damaged, the Occupational Safety and Health Administration (OSHA) recently set up standards under Title 29, Chapter XVII concerning compressed gas equipment for diving purposes. "Compressed gas euipment, such as cylinders, must be stored in a well ventilated area and protected from heat or falling. They must have protection caps over the necks and valves when not in use." Though Section 1910.437 of Title 29, specifically exempts "Scuba Cylinders" therefrom, Paragraph (b) states that but with this exception "Compressed gas cylinders shall have a protection cap over the cylinder neck and valve when not in use." It is thought that this exemption is due to the fact that the pressurization of scuba tanks or cylinders is generally lower than in other commercial areas, but the danger created by a valve assembly being broken from a scuba tank is just as potentially hazardous as that from any other pressurized cylinder.

In accordance with the foregoing, it is a primary object of this invention to provide a novel protector cap for the valve or valve assembly of any type of compressed gas cylinders, commercial or otherwise, but specifically for scuba cylinders.

In further keeping with this invention, a primary purpose is to provide a novel protector cap which is generally of a frusto-conical configuration defined by an end wall and a frusto-conical peripheral skirt, a pair of diametrically opposite grooves in the peripheral skirt merging with a groove in the end wall of the cap, and strap means disposed in these grooves and passing through aligned apertures for securing the protector cap in overlying relationship to the neck end and valve or valve assembly of an associated compressed gas cylinder.

Still another object of this invention is to provide a novel device of the type aforesaid wherein a bottom portion of the compressed gas cylinder is also received in a cap having an end wall and a peripheral skirt, the end wall and periphal skirt likewise including aligned grooves and apertures, and the strap means pass through the latter apertures and grooves to retain the compressed gas cylinder captively sandwiched between the two caps.

A further object of this invention is to form the grooves of the protector cap by diametrically opposed inwardly directed ribs which efectively define a divided chamber in the protective cap into which portions of the valve assembly are readily received.

Yet another object of this invention is to provide the protector cap with a plurality of spaced radially outwardly directed projections which preclude the cylinder from rotating when resting upon a supporting surface.

Still another object of this invention is to provide a protector cap of the tupe aforesaid wherein inwardly directed ribs are further provided for aligning the neck portion of the compressed gas cylinder with the protector cap.

With the above and other objects in view that will hereinafter appear, the nature of the invention will be more clearly understood by reference to the following detailed description, the appended claimed subject matter, and the several views illustrated in the accompanying drawings.

IN THE DRAWING

FIG. 1 is a perspective view of a novel device constructed in accordance with this invention, and illustrates a pair of caps held to a compressed gas cylinder by a strap with one of the caps being of a frusto-conical configuration, and having projections which prevent rotation of the assembly when placed with the axis of the cylinder generally parallel to a supporting sirface.

FIG.2 is an enlarged fragmentary sectional view taken generally along line 2—2 of FIG. 1, and illustrates the manner in which a valve assembly of the compressed gas cylinder is housed within a chamber of an uppermost one of the caps.

FIG. 3 is a sectional view taken generally along line 3—3 of FIG. 2 in the absence of the compressed gas cylinder, and illustrates internal details of the upper or protector cap.

FIG. 4 is a cross-sectional view taken generally along line 4—4 of FIG. 2 in the absence of the compressed gas cylinder, and illustrates interior details of the bottom cap.

A novel device constructed in accordance with this invention for protecting values or valve assemblies of compressed gas cylinders is generally designated by the reference numeral 10 and includes an upper protector cap 11, a lower cap 12, and a pair of straps 13, 14. The device 10 is associated with a compressed gas cylinder C which may be but is not limited to a scuba tank which includes a bottom portion B, a top portion T having a neck N and a valve assembly V, the latter of which includes at least an inlet port, an outlet port, and a manual valve (unnumbered). The valve assembly V may be more sophisticated and further include a check valve at the inlet side, a pressure gauge, and a relief valve so as to prevent excessive pressure buildup within the cylinder C. The valve knob or handle (unnumbered) and inlet or outlet are generaly in alignment and are normal to and project radially in diametrically opposite directions from each other normal to the axis (unnumbered) of the cylinder C.

The upper generally frusto-conical protector cap 11 includes an end wall 15 and a frusto-conical peripheral skirt 16 having a lower terminal edge portion 17. The end wall 15 has a generally centraL circular depression 18 traversed by a groove 20 which bisects the axis (unnumbered) of the protector cap 11, the cylinder C and the lower cap 12. The groove 20 merges with diametrically opposite grooves 21, 22 which also lie in an axial plane of the protective cap 11, the cylinder C and the bottom cap 12. The grooves 21, 22 open in an outward direction and are defined by respective walls 23 through 25 and 26 through 28 (FIG. 3). As viewed from the exterior of the protector cap 11, the grooves 21, 22 open generally radially outwardly while as viewed from the interior (FIG. 3.), the walls 23 through 25 and 26 through 28 define inwardly directed ribs 30, 31, respectively.

The terminal peripheral edge portion 17 of the peripheral skirt 16 of the protector cap 11 includes a pair of apertures 32, 33 which are in alignment with the respective grooves 21, 22 as is best illustrated in FIG. 2. The apertures 32, 33 are formed in radially outwardly directed sleeve portions 34, 35, respectively, of the terminal edge portion 17 of the peripheral skirt 16. The strap means or strap 13 passes through both of the apertures 32, 33 and is disposed in the grooves 20 through 22 in the manner best illustrated in FIG. 2.

Adjacent the terminal edge portion 17 of the peripheral skirt 16 are a plurality (four) of radially outwardly directed projections each being designated by the reference numeral 36 (FIGS.1 and 3). The projections 36 are arranged in pairs to either side of an axial plane passing through the protector cap 11 which bisects the sleeve portions 34, as is best illustrated in FIG. 3, and the projection 36 at each side of the latter-noted plane most adjacent the sleeve portions 34 is spaced therefrom approximately 60° . The purpose of the projections 36 is to prevent rotation of the container C when the device 10 is attached thereto and the overall assembly as best shown in FIGS. 1 and 2 is resting upon a supporting surface which may be horizontal or slightly inclined. Preferably the projections 36 project radially outwardly to a point which at least contacts an imaginary line tangent to an exterior surface (unnumbered) of the terminal peripheral edge 17 of the peripheral skirt 16, as is best illustrated in FIG. 3, with the imaginary tangential line being indicated by the reference character L. Due to the latter arrangement, two of the projections 36 will at all times contact a supporting surface which is horizontal or for that matter inclined and thus prevent rotation of the cylinder C which might otherwise occur in the absence of the protector cap 11. Such rotation of the cylinder C apart from the device 10 could, of course, cause the valve assembly V to strike an object, become fractured or broken and cause damage heretofore noted. However, due to the radially outwardly directed projections 36 rotation of the cylinder C during storage positions is virtually precluded even if the cylinder C is not tied down or otherwise tethered.

An identical inwardly directed rib 37 is associated with each of the projections 36. Each rib 37 is defined by side walls 40, 41, a wall 42 which is parallel to the axis of the protector cap 11 and an inclined wall 43 which defines an included angle of approximately twenty-five degrees relative to the axis of the protector cap 11. The walls 43 of each of the inwardly directed ribs 37 contact the top end portion T (FIG. 2) of the compressed gas cylinder C and center the protector cap 11 thereupon.

The bottom cap 12 includes an end wall 45 and a peripheral skirt 46. The end wall 45 includes a pair of outwardly opening crossing grooves 47, 48 which are normal to each other and which have center lines lying in an axial plane of the cap 12 and the container C when the bottom portion B of the latter is disposed therein, (FIG. 2). The grooves 47, 48 are in alignment with respective diametrically opposed pairs of apertures 50, 50 and 51, 51 of the peripheral skirt 46 which are formed by respective sleeve portions 52, 53. The groove 48 and the apertures 51 are aligned with the apertures 32, 33 and the grooves 20, as is readily apparent from FIG. 2. The strap 14 passes through the apertures 51 and the groove 48 with a terminal end portion 55 of the strap 14 being connected to a spring clasp 56 of the strap 13 while a terminal end portion 57 of the strap 13 is locked to a spring clasp 58 carried by the strap 14 in the manner best illustrated in FIG. 2. In this manner, the container C is securely captively held between the caps 11, 12 and damage to the valve assembly V is precluded by the protector cap 11.

Obviously the length of the straps 13, 14 can be selected such that the device 10 is suitable for use with cylinders C of varying lengths, and should it be desired straps identical to the straps 13, 14 can be utilized in conjunction with the apertures 50, 50. In the latter case, the protector cap 11 can be modified to dispose a sleeve portion 34 and an associated aperture 32 between adjacent pairs of projections 36, 36 and further provide the cap 11 with additional grooves 21, 22 in diametrically opposed relationship to each other lying in an axial plane normal to the axial plane passing through the illustrated grooves 21, 22.

While preferred forms and arrangement of parts have been shown in illustrating the invention, it is to be clearly understood that various changes in details and arrangement of parts may be made without departing from the spirit and scope of this disclosure.

What is claimed is:

1. A device for protecting a compressed gas cylinder of the type including a bottom end portion and an opposite top end portion with the latter having a valve assembly comprising a pair of caps, each of said caps being of a generaly cup-shaped configuration defined by an end wall and a peripheral skirt, said caps being adapted to be disposed in opposed relationship to each other, a first of said caps defining a first chamber adapted to receive therein a bottom end portion of a compressed gas cylinder, a second of said caps defining a second chamber adapted to receive therein a top end portion of a compressed gas cylinder and a valve assembly carried by the top end portion, a first plurality of aperture means in the peripheral skirt of said first cap, a second plurality of aperture means in the peripheral skirt of said second cap, and strap means for passing through said first and second plurality of aperture means to captively retain a compressed gas cylinder therebetween.

2. The device as defined in claim 1 including first groove means in said first cap end wall in alignment with said first aperture means for the receipt therein of said strap means, and second groove means in said second cap end wall in alignment with said second aperture means for the receipt therein of said strap means.

3. The device as defined in claim 1 wherein the peripheral skirt of said second cap includes a pair of diametrically opposite inwardly projecting rib means for partially dividing said second chamber into a pair of chamber portions adapted to receive radially oppositely directed portions of an associated valve assembly.

4. The device as defined in cliam 1 wherein the peripheral skirt of at least one of said caps includes means for preventing rotation of said at least one cap about its axis when resting upon a supporting surface.

5. The deivce as defined in claim 1 wherein the peripheral skirt of at least one of said caps includes means for preventing rotation of said at least one cap about its axis when resting upon a supporting surface, and said rotation preventing means being a pair of circumferentially spaced outwardly directed projections.

6. The device as defined in claim 1 wherein the peripheral skirt of at least one of said caps includes means for preventing rotation of said at least one cap about its axis when resting upon a supporting surface, said rotation preventing means being a pair of circumferentially spaced outwardly directed projections, said at least one cap has an exterior circumferential surface, and said projections project outwardly beyond said exterior circumferential surface to a common imaginary line tangent to said exterior circumferential surface.

7. The device as defined in claim 1 wherein said second cap is of a generally frusto-conical configuration having a peripheral terminal edge portion axially remote from said second cap end wall, a pair of diametricaly disposed grooves in said second cap peripheral skirt merging with a groove in said second cap end wall, and said grooves and second plurality of aperture means being disposed in an axial plane whereby said strap means also pass through said grooves.

8. The device as defined in claim 7 wherein the peripheral skirt of said second cap includes a pair of diametrically opposite inwardly projecting rib means for partially dividing said second chamber into a pair of chamber portions adapted to received radially oppositely directed portions of an associated valve assembly.

9. The device as defined in claim 7 wherein the peripheral skirt of at least one of said caps includes means for preventing rotation of said at last one cap about its axis when resting upon a supporting surface, and said rotation preventing means being a pair of circumferentially spaced outwardly directed projections.

10. The device as defined in claim 8 wherein the peripheral skirt of said second cap includes a pair of diametrically opposite inwardly projecting rib means for partially dividing said second chamber into a pair of chamber portions adapted to received radially oppositely directed portions of an associated valve assembly.

11. The combination of a comrpressed gas cylinder and a protector cap comprising a compressed gas cylinder of the type including a bottom end portion, an opposite top end portion and a valve assembly carried by the latter, a protector cap of a generally cup-shaped configuration defined by an end wall and a peripheral skirt, said end wall and peripheral skirt defining a chamber within which is received said valve assembly, said peripheral skirt being of a generally frusto-conical configuration and terminating in a peripheral terminal edge portion axially remote from said end wall, a pair of diametrically disposed grooves in said peripheral skirt merging with a groove in said end wall, an aperture in said peripheral terminal edge porton adjacent to and aligned with an associated one of said pair of grooves, and strap means disposed in said grooves, passing through said apertures, and underlying said compressed gas cylinder bottom end portion whereby said protector cap is captively secured upon said compressed gas cylinder to protect said valve assembly.

12. The combination as defined in claim 11 including a second cap defined by an end panel and a peripheral skirt, said second cap end panel and peripheral skirt defining a second chamber receiving therein the bottom end portion of said comressed gas cylinder, a pair of diametrically disposed grooves in the peripheral skirt of said second cap merging with a groove in the end wall of said second cap, an aperture in said second cap peripheral skirt adjacent to an aligned with an associated one of said pair of grooves of said second cap, and said strap means being additionally respectively disposed in and passing through said grooves and apertures of said second cap.

13. The combination as defined in claim 11 wherein said valve assembly includes opposite radially outwardly directed portions, said protector cap grooves are defined by inwardly directed ribs, said ribs partially divide said protector cap chamber into a pair of chamber portions, and each of said chamber portions receives one of said valve assembly portions.

14. The combination as defined in claim 11 wherein said peripheral terminal edge portion includes means for preventing rotation of said combination about its axis when resting upon a supporting surface.

15. The combination as defined in claim 12 wherein said valve assembly includes opposite radially outwardly directed portions, said protector cap grooves are defined by inwardly directed ribs, said ribs partially divide said protector cap chamber into a pair of chamber portions, and each of said chamber portions receives one of said valve assembly portions.

16. The combination as defined in claim 12 wherein said peripheral terminal edge portion includes means for preventing rotation of said combination about its axis when resting upon a supporting surface.

* * * * *